US006824035B1

(12) United States Patent
Łagodzińska et al.

(10) Patent No.: US 6,824,035 B1
(45) Date of Patent: Nov. 30, 2004

(54) POWER OPERATED PISTON TOOL WITH PISTON AUTOMATIC RETURN

(76) Inventors: Marek Łagodziński, ul. Ćwiklińskiej 2 m 19, 92-508 Łódź, Poland, Łódź (PL), 92-508; Bogusława Łagodzińska, ul.Ćwiklińskiej 2 m 19, 92-508 Łódź, Poland, Łódź (PL), 92-508; Zbigniew Rogowski, ul.Dąbrówki 17 m 25, 92-413 Łódź, Poland, Łódź (PL), 92-413

( * ) Notice: Subject to any disclaimer, the term of this patent is extended or adjusted under 35 U.S.C. 154(b) by 0 days.

(21) Appl. No.: 09/582,890

(22) PCT Filed: Dec. 31, 1998

(86) PCT No.: PCT/PL98/00052

§ 371 (c)(1),
(2), (4) Date: Jul. 7, 2000

(87) PCT Pub. No.: WO99/36230

PCT Pub. Date: Jul. 22, 1999

(30) Foreign Application Priority Data

Jan. 19, 1998 (PL) ..... 324361

(51) Int. Cl.[7] ..... B25C 1/14

(52) U.S. Cl. ..... 227/10; 227/156; 173/211; 267/153

(58) Field of Search ..... 227/10, 11, 9, 227/156; 173/212, 211; 267/151, 152, 153, 162

(56) References Cited

U.S. PATENT DOCUMENTS

| | | | | | |
|---|---|---|---|---|---|
| 3,263,985 | A | * | 8/1966 | Planta | 267/141.6 |
| 3,272,491 | A | * | 9/1966 | Knittel | 267/145 |
| 3,331,546 | A | * | 7/1967 | Brunelle | 227/10 |
| 3,687,440 | A | * | 8/1972 | Jarret et al. | 267/141 |
| 4,122,987 | A | * | 10/1978 | Jochum et al. | 227/10 |
| 4,436,238 | A | * | 3/1984 | Seki | 227/149 |
| 4,591,030 | A | * | 5/1986 | Antkowiak | 188/268 |
| 4,618,130 | A | * | 10/1986 | Veglia | 267/153 |
| 4,905,972 | A | * | 3/1990 | Scowen | 267/152 |
| 5,065,988 | A | * | 11/1991 | Wedell | 267/149 |
| 5,240,269 | A | * | 8/1993 | Kerr | 280/285 |
| 5,901,894 | A | * | 5/1999 | Melocco | 173/211 |
| 6,059,163 | A | | 5/2000 | Pfister et al. | 227/10 |

FOREIGN PATENT DOCUMENTS

| | | |
|---|---|---|
| EP | 0 223 740 | 5/1987 |

* cited by examiner

*Primary Examiner*—Scott A. Smith
*Assistant Examiner*—Louis Tran
(74) *Attorney, Agent, or Firm*—Katten Muchin Zavis Rosenman

(57) ABSTRACT

The present invention provides a defect-less and easy to operate power actuated piston tool with automatic piston return, designated for driving fasteners into a base like masonry, concrete, wood or the like. The tool according to the invention is characterized by that on piston shank (11) of piston (1), there is an elastic returning bush (7), situated between piston head (12) and fastener guide (5), said returning bush (7) is a one-piece in shape of bellow, made of elastomeric material, of regularly variable diameter.

15 Claims, 4 Drawing Sheets

POWER OPERATED PISTON TOOL WITH PISTON AUTOMATIC RETURN

BACKGROUND OF THE INVENTION

1. Field of the Invention

The present invention relates to a power operated piston tool with piston automatic return.

2. Brief Description of the Background of the Invention Including Prior Art

In power operated piston tools, of indirect action, designed for driving fastening elements into a base like masonry, concrete, wood or the like, a piston element, driven by firing gases, coming from firing cartridge, is used as an intermediary element, acting upon the fastening element, as opposite to tools of direct action, where firing gases act directly upon the fastening element.

In the tools of indirect action, the piston after fastening is in its forward position, that its piston tip is at the fastener guide muzzle end. In order to return the piston to its firing position, in conventional, semiautomatic tools, manual reloading is required. This reloading consists of pulling backward the barrel means, having a returning tooth, engaging the respective cavity on piston means, which causes the piston to return. This operation is also used to shift the firing cartridge belt by one position, thus making the tool ready for next firing.

In other kind of power piston tools, described in patent EP 0223740, the piston return is actuated by the firing gases, which, after pushing the piston to its forward position, while still expanding, cause the piston to retract. However, after retracting, the piston strikes against its rear abutment, thus causing the reflection effect, which may displace the piston of some distance from its firing position, creating a dead space, decreasing the firing power of a subsequent fire. As a result, fasteners are driven into the base at uneven depth and the firing chamber becomes spoiled with firing remains, due to incomplete burning of blowing charge. Besides, problems can occur when the piston itself is driven into the base after fastening operation. In that case, to return the piston to its firing position, an additional manual push-rod is needed. In any case, after transporting or other periods of prolonged disuse of the tool, it is always useful to check with manual push-rod, whether the piston is well in its firing position, the only one initial position ensuring tool correct functioning.

In another kind of power piston tool, illustrated in U.S. Pat. No. 3,331,546, to return the piston member, a plurality of stacked washers constructed from polyurethane elastomer, are applied. The washers are positioned within the barrel, on the piston shank. After firing the washers are rapidly collapsed, thus absorbing part of firing energy and functioning as a buffer. At the end of power stoke, and after dissipation of the firing gases, escaping through vent holes in the barrel, the washers will return to their original shape, due to elastic memory, and thus they return a piston to its firing position. The venting holes, situated in washers' side portions cause stress concentration and thus damage to spring elements. The other problem arises when exchanging worn-out washer elements, as they require strictly defined positions and quantity, otherwise malfunction may occur, if not a serious tool damage.

SUMMARY OF THE INVENTION

1. Purposes of the Invention

It is an object of this invention to provide a power operated piston tool, free from above mentioned imperfections, in which the piston return is carried-out mechanically, by use of one-piece elastic returning bush.

It is another object of the present invention to provide a power operated piston tool in which a piston is correctly positioned in its initial position after firing.

These and other objects and advantages of the present invention will become evident from the description which follows.

2. Brief Description of the Invention

The present invention provides for a power actuated piston tool for driving fasteners into a base like masonry, concrete, wood. The power actuated piston tool with automatic piston return is composed of an external barrel with a guiding barrel and a guide fastener and a piston means moveably mounted in the guiding barrel and the fastener guide. The piston means is formed of a piston shank inserted in the fastener guide and a piston head guided in the guiding barrel. A returning bush is situated on the piston shank between the piston head and the fastener guide. The returning bush is made of elastomeric material and has a shape of bellows, whose diameters both external and internal are regularly varied. The walls are so formed that the returning bush approximates to a sinusoid, or to a stack of truncated-spherical segments, or frusto-conical segments, or a stack of barrel-shaped segments or/and other revolution segments, creating uniformly spaced swellings and narrowings with a wave-like structure.

The returning bush according to this invention advantageously has a maximum internal diameter of at least one segment at its both ends of a slightly smaller size than the respective diameter of the remaining segments, so the end segment walls are thicker than the other segment walls.

The internal end surface of external segments is markedly curved outside in such a way, that the centre of curvature of the bush ends is clearly distanced from the bush face. The length of the returning bush is selected in such a way that after initial blocking, the piston shank end face does not reach its extreme forward position and remains at a distance from the base, the distance being slightly greater than the head height of the fastening element. The maximum external diameter of the returning bush according to the present invention is smaller than the internal diameter of the guiding barrel, so that, in an initial blocking position of the returning bush, its external diameter still remains smaller than the internal diameter of the guiding bush, thus preserving a slight clearance.

After fully driving the fastening element into the base, and subsequent stopping of the piston's movement, the energy accumulated in the returning bush is relieved and returns the piston to the rear, due to the shape-memory of the elastomeric material. It is the first and the greatest returning force acting upon the piston. After returning the piston to its rear position, there remains some slight force due to not fully recovering the bush free shape, which force retains the piston in its rear position, i.e. the firing position.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The object of this invention is illustrated in a preferable embodiment in the accompanying drawings in which.

DESCRIPTION OF INVENTION AND PREFERRED EMBODIMENT

Figure 1:
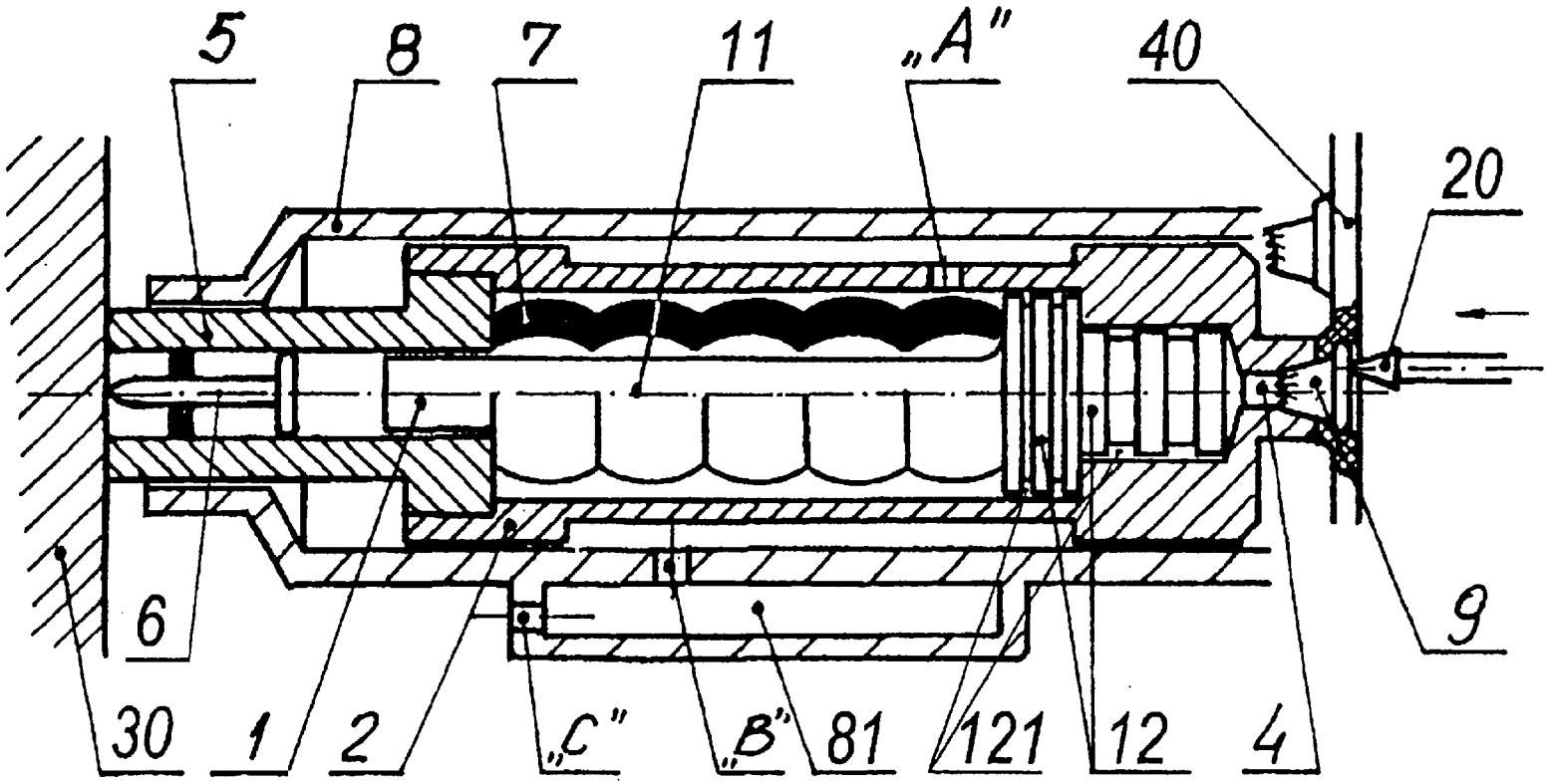
FIG. 1 is a longitudinal cross sectional view of the power piston tool, showing the piston in its firing position, at the moment of firing the cartridge.
Figure 2:
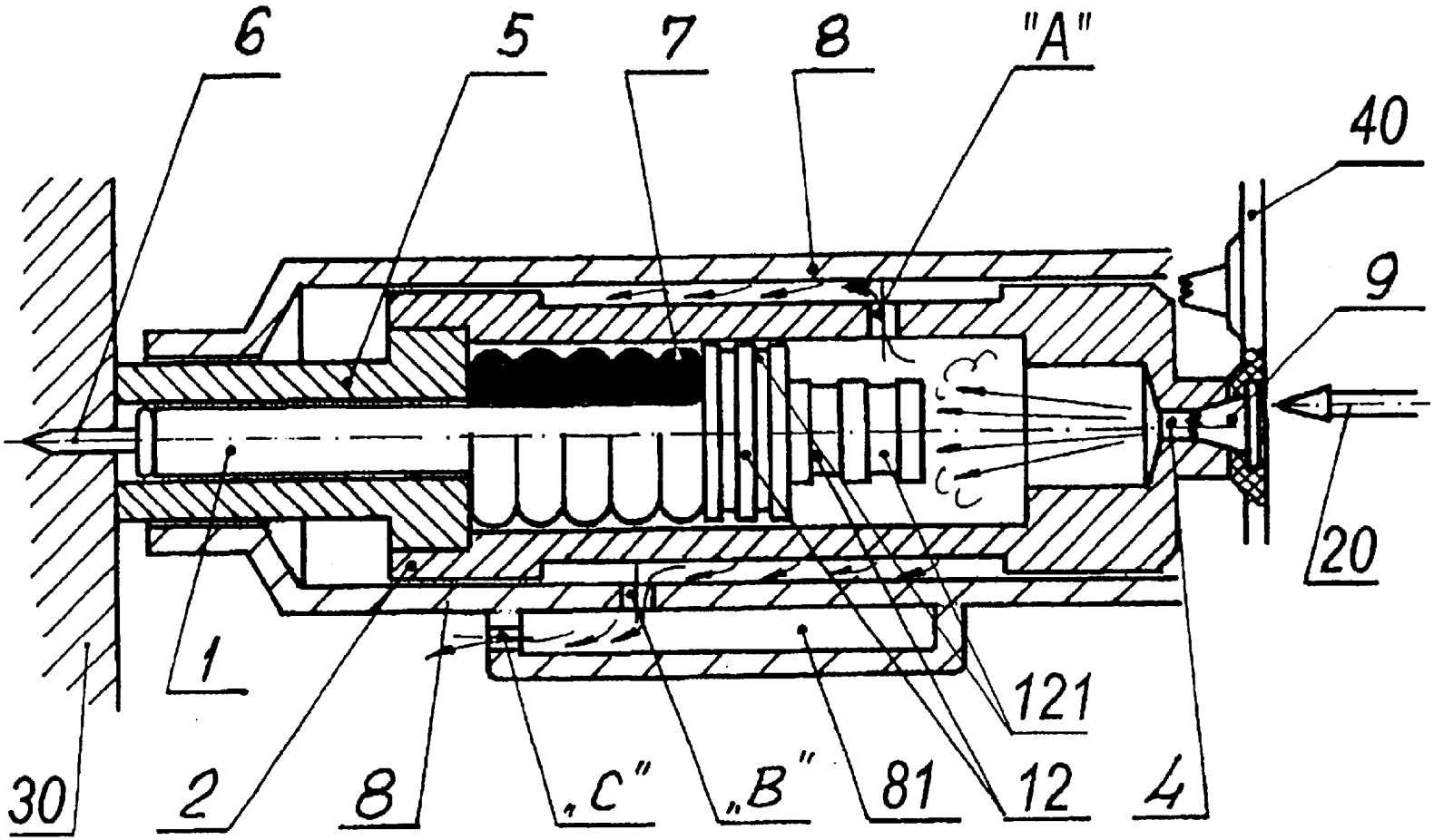
FIG. 2 is the same view showing the piston at the end of normal power stroke, at the moment of driving the fastening element into a base, after initial blocking of returning bush.
Figure 3:
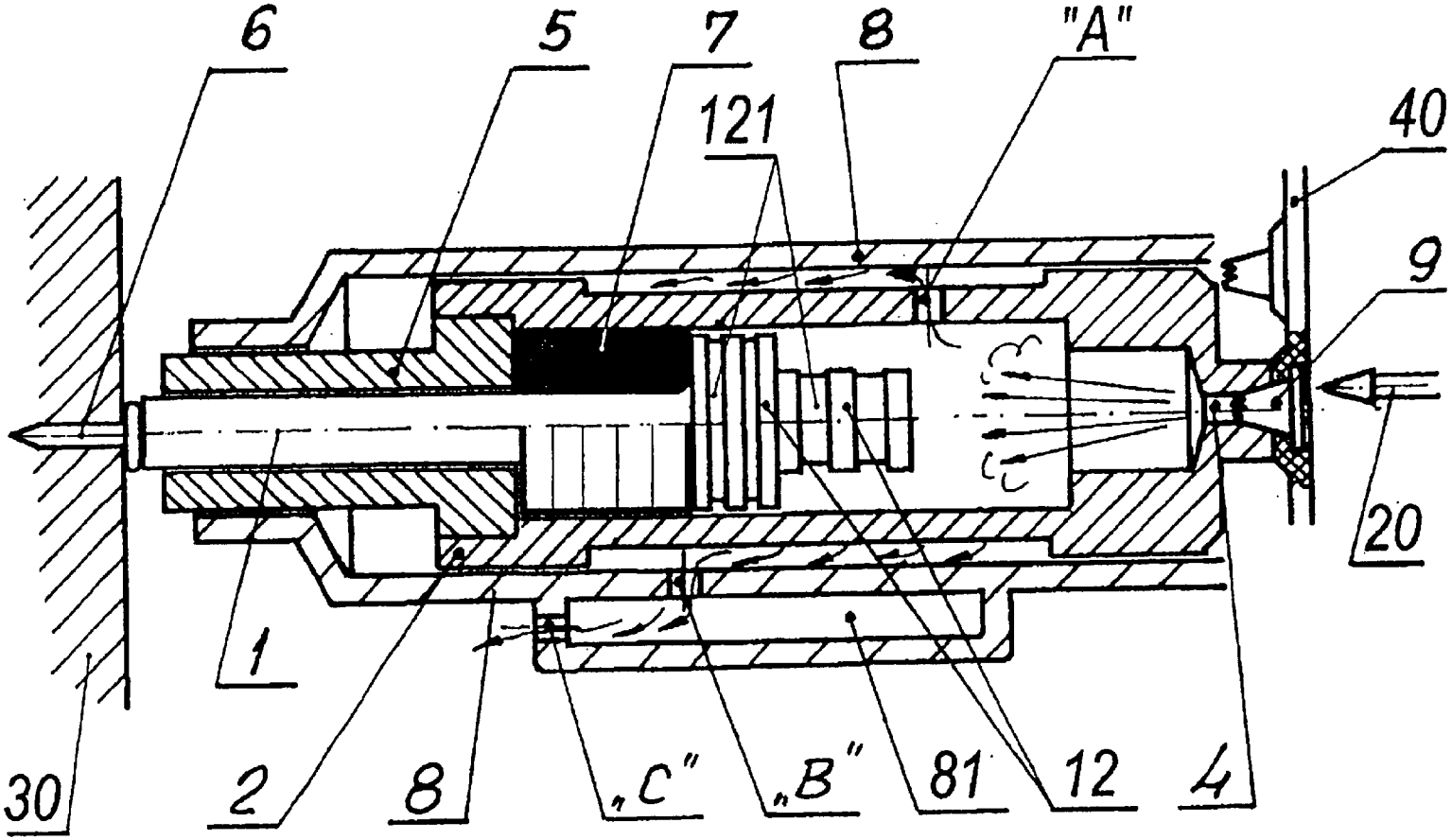
FIG. 3 is the same view after driving the fastening element fully into the base.
Figure 4:
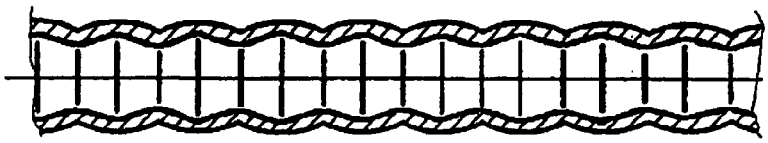
FIG. 4 is the cross sectional view of the middle part of the returning bush and FIG. 5 is somewhat an enlarged view of one of the returning bush ends in the cross section.
Figure 5:
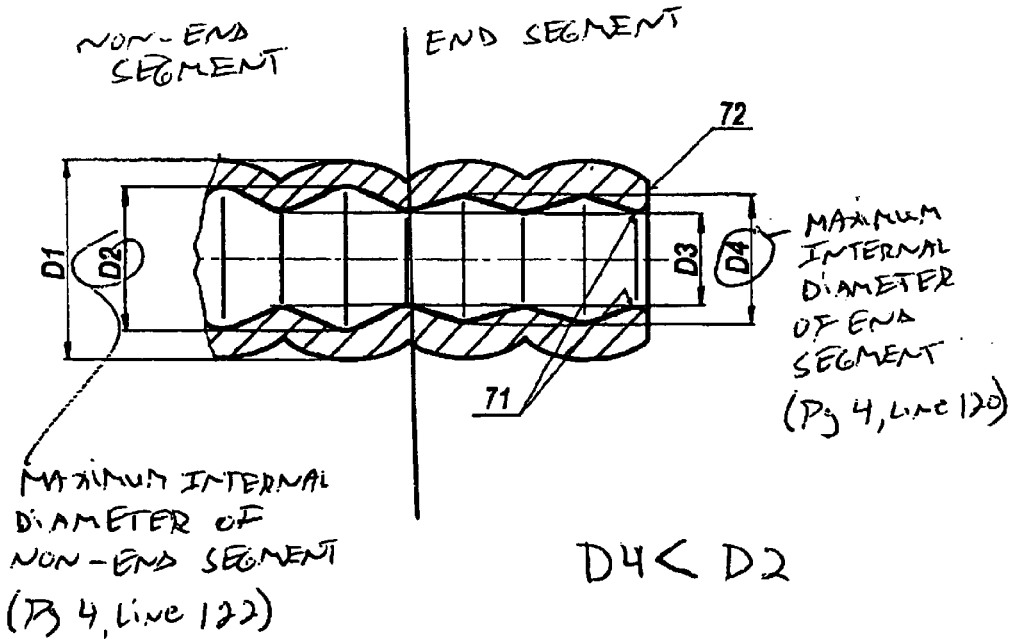

In a power tool shown in FIG. 1 a piston 1, mounted for reciprocation within a guiding barrel 2, is in its firing position at the rear end of the guiding barrel 2 where a piston head 12 is proximal to a firing chamber 4. On the piston shank 11, between the piston head 12 and a fastener guide 5, an elastic returning bush 7 is mounted, being in the shape of a one piece bellows, constructed from elastomer material, whose both external and internal diameters are regularly varied. The walls of the returning bush 7 approximate in shape to a stack of truncated-spherical or frusto-spherical segments, creating uniformly spaced swellings and narrowings of a wave-like structure. In another embodiment of the invention the returning bush takes the shape of a stack of frusto-conical segments. In yet another embodiment of the invention, the returning bush assumes the shape of the stack of barrel-shaped segments or/and another revolution segments. The returning bush 7 has a maximum internal diameter D4, of its extreme two segments at each end being of slightly smaller size than the respective diameter D2 of the remaining segments, so that the bush end segment walls are a little thicker than the other segments walls. The internal end surface of the external segments is markedly curved outside in such a way, that the position 71 of the curvature points of the bush ends is clearly distanced from the bush faces 72. The length of the returning bush 7 is selected in such a way that after initial blocking of the returning bush 7, the piston shank 1 end-face does not reach its extreme forward position and remains at a distance from the base 30, the distance being slightly greater than the head height of the fastening element 6. The maximum external diameter D1 of the returning bush 7 is sufficiently smaller than the internal diameter of the guiding barrel 2, that, after initial blocking of the returning bush 7, its external diameter still remains smaller than the internal diameter of the guiding barrel 2, thus preserving a slight clearance. When the piston 1 is in its firing position, an initial stress within the returning bush 7 remains, enough to ensure that the piston head 12 abuts the bottom of the barrel 2, near the firing chamber 4. On the piston head 12 there are multiple grooves 121 acting to seal the gases created during firing and providing some space to gather impurities. Ports A in the guiding barrel 2 and ports B and C in the external barrel 8 are provided to enable the firing gases to be discharged after firing.

After firing the cartridge 9 upon striking the firing pin 20, the firing gases set the piston 1 into motion, with rapidly accelerating velocity, towards the fastener 6. The piston head 12, after passing the port A, opens the gas flow connection toward the space between the guiding barrel 2 and the external barrel 8 and from there, through port B, toward silencer 81 and from there, via port C, to atmosphere, thus reducing the firing noise and the gas pressure in the firing chamber, to a value close to atmospheric pressure. The accelerated piston 1 strikes against the fastener 6, driving it into the base 30, and at the same time, compressing the returning bush 7. At a distance of several millimeters before fully setting the fastener 6 into the base 30 initial blocking of the returning bush 7 takes place. In this position the piston shank 1 end-face does not reach its extreme forward position and remains at some distance from the base 30, slightly greater than the head height of fastener 6 and a clearance exists between the guiding barrel 2 and returning bush 7. The returning bush 7, at the final stage of the piston's motion, forms a closed tubular column, thus absorbing little firing energy, which ensures driving the fastener 6 to its full depth. In the event of free flight shot or overdrive of the piston, this shut tubular column will function as a buffer, to absorb the high energy of the piston 1.

After driving the fastener 6 into the base 30, the piston 1 stops and due to elastic memory, inherent in elastomeric material, the returning bush 7 will return the piston 1 to its firing position, where it is ready for the next firing operation. This is facilitated because the counter-pressure acting upon the piston 1 from the firing chamber 4, has fallen to atmospheric pressure.

To reload the power piston tool, it should be removed from contact with the base 30, then the springs of the firing-pin assembly move the subassembly of piston 1 and its guiding barrel 2 forward by a stroke, enabling: first the removal of the fired cartridge 9 from the firing chamber 4 and, secondly, after the tool is pressed anew against base 30 for the subsequent firing, to shift the cartridge belt 40 by one position.

By virtue of the particular configuration of the elastic returning bush 7, during the normal power stroke, substantially little energy will be absorbed by the returning bush 7 being pressed, and thus there will be little interference with the velocity of the piston 1, so the bulk of the firing energy is used to drive the fastener 6 into the base 30, while only a small portion of this energy will be used for returning the piston 1 to its firing position, thus reducing the tool recoil effect and ensuring that the piston 1, will always return to its firing position, after venting the space behind its head 12. The particular wave-like shape of the returning bush 7, as well as, thickening the returning bush 7 end segments and the particular position of curvature points of the ends of the returning bush 7 ensures correct functioning of the tool and eliminates the elastomeric bush tendency to curl, which tendency could lead to a situation when the piston 1 could be blocked within the guiding barrel 2. Besides, the returning bush 7 does not oppose a great resistance to the piston 1 movement, so it does not reduce its velocity and it does not impair the effectiveness of placing the fasteners and does not provoke any tool recoil effect.

It will be understood that each of the elements described above, or two or more together, may also find a useful application in other types of piston tools differing from the types described above.

While the invention has been illustrated and described as embodied in the context of a power actuated piston tool with an automatic piston return, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A power actuated piston tool with a piston automatic return, comprising:

an external barrel having a rear end;

a guiding barrel disposed in the external barrel;

a fastener guide disposed in the external barrel;

a piston means having a piston shank and a piston head disposed in said guiding barrel, said piston means being configured to be moveable between a firing position, an initial position, and a fastening position;

a firing-pin assembly disposed at the rear end of the external barrel and operatively connected to the external barrel; and piston return means configured to automatically return the piston means from the fastening position to the firing position, said piston return means being disposed on said piston shank between the piston head and the fastener guide, said piston return means comprising a one piece elastic returning bush having a shape of bellows, said returning bush having (i) an external bellows diameter which varies regularly in a longitudinal direction, and (ii) an internal bellows diameter which varies regularly in the longitudinal direction, said piston return means being configured such that, in the initial position, a sum of a longitudinal length of said piston return means plus a longitudinal length of the fastener guide is greater than a longitudinal length of the piston shank, said returning bush having at least one end segment comprising two narrowings and one swelling, the maximum internal diameter of said at least one end segment being less than the maximum internal diameter of non-end segments of said returning bush, said at least one end segment having a maximum wall thickness which is greater than maximum wall thicknesses of the non-end segments.

2. The power actuated piston tool according to claim 1, wherein said returning bush is configured to approximate at least one of (i) a stack of truncated-spherical segments, (ii) a stack of frusto-conical segments, and (iii) a stack of barrel-shaped segments.

3. The power actuated piston tool, according to claim 2, wherein at least one of the two end segments of the returning bush has an internal end surface that is curved such that a position of a center of curvature of the curved end surface is disposed at a distance from an end-face of said piston return means.

4. The power actuated piston tool, according to claim 2, wherein a length of said returning bush is configured such that, in the initial position, a piston shank end-face does not reach its extreme forward position and remains at a distance from a base.

5. The power actuated piston tool, according to claim 2, wherein a maximum external diameter of said returning bush is configured to be smaller than an internal diameter of the guiding barrel such that, in the initial position, an external diameter of said returning bush is smaller than the internal diameter of the guiding barrel.

6. A power operated piston tool with a piston automatic return, comprising:

an outer barrel having a firing chamber at a first end thereof;

a guiding barrel mounted in the outer barrel;

a fastener guide having a thin end with an outer surface and a thick part disposed in the guiding barrel, said fastener guide being configured such that said thin end protrudes from the outer barrel;

a piston having (i) a piston head disposed in the guiding barrel and (ii) a piston shank disposed in the fastener guide, said piston being configured to be moveable from a firing position to an initial blocking position and to a fastening position;

a firing-pin assembly mounted at the first end of the outer barrel; and a hollow element having a bellows shape configured to cause an automatic return of the piston from the fastening position to the firing position, said hollow element being disposed on the piston shank between the piston head and the fastener guide, said hollow element comprising an elastomeric material, an external diameter of the hollow element and an internal diameter of the hollow element both varying regularly to form uniformly spaced swellings and narrowings running longitudinally on an outer surface and an inner surface of the hollow element, wherein between each two neighboring narrowings is formed a segment with at least one of (i) a sinusoidal, (ii) a frusta-spherical, (iii) a frusta-conical, and (iv) a barrel wall contour, and wherein, in the initial blocking position, a sum of a longitudinal length of said hollow element plus a longitudinal length of the fastener guide is greater than a length of the piston shank, said hollow element having at least one end segment comprising two narrowings and one swelling, the maximum internal diameter of said at least one end segment being less than the maximum internal diameter of non-end segments of said hollow element, said at least one end segment having a maximum wall thickness which is greater than maximum wall thicknesses of the non-end segments.

7. The power operated piston tool according to claim 6, wherein an inner end surface of end segments of said hollow element is outwardly curved.

8. The power operated piston tool according to claim 6, wherein a sum of a longitudinal length of said hollow element plus a length of the fastener guide is greater than a length of the piston shank, said piston being configured such that a piston shank end face is distanced from the outer surface of the fastener guide in an initial blocking position of the piston.

9. A power operated piston tool with a piston automatic return, comprising:

an outer barrel having a firing chamber at a first end thereof;

a guiding barrel mounted in the outer barrel;

a fastener guide having a thin end with an outer surface and a thick part disposed in the guiding barrel, said fastener guide being configured such that said thin end protrudes from the outer barrel;

a piston having (i) a piston head disposed in the guiding barrel and (ii) a piston shank disposed in the fastener guide, said piston being configured to be moveable between a firing position and a fastening position;

a firing-pin assembly mounted at the first end of the outer barrel; and a one-piece hollow element formed of segments and disposed on the piston shank between the piston head and the fastener guide, said hollow element comprising elastomeric material, wherein a sum of a length of the fastener guide plus a length of said hollow element when the piston is in an initial blocking position is greater than a length of the piston shank, said piston being configured such that a piston shank end face is distanced from the outer surface of the fastener guide in the initial blocking position of the piston, said hollow element having at least one end segment comprising two narrowings and one swelling, the maximum internal diameter of said at least one end segment being less than the maximum internal diameter of non-end segments of said hollow element, said at least one end segment having a maximum wall thickness which is greater than maximum wall thicknesses of the non-end segments.

10. The power operated piston tool according to claim 9, wherein a wall of each segment of the segments of the hollow element has a sinusoidal cross-section.

11. The power operated piston tool according to claim 9, wherein a wall of each segment of the segments of the hollow element has a frustum of sphere cross-section.

12. The power operated piston tool according to claim 9, wherein a wall of each segment of the segments of the hollow element has a frustum of a cone cross-section.

13. The power operated piston tool according to claim 9, wherein a wall of each segment of the segments of the hollow element has a barrel cross-section.

14. The power operated piston tool according to claim 9, wherein a wall of each segment of the segments of the hollow element has a frustum of barrel cross-section.

15. The power actuated piston tool according to claim 1, wherein said returning bush comprises an elastomeric material.

* * * * *